United States Patent [19]

Van de Carr et al.

[11] Patent Number: 4,655,715

[45] Date of Patent: Apr. 7, 1987

[54] COMBINED COORDINATION TRAINER AND BABY BOTTLE HOLDER

[76] Inventors: F. Rene Van de Carr, 27225 Calaroga Ave., Hayward, Calif. 94545; Marc Lehrer, 1466 7th Ave., San Francisco, Calif. 94122

[21] Appl. No.: 805,863

[22] Filed: Dec. 6, 1985

[51] Int. Cl.[4] ..... A47D 15/00

[52] U.S. Cl. ..... 434/258; 40/324; 248/102

[58] Field of Search ..... 40/310, 324, 362; 248/102, 103; 434/258; 446/227, 347

[56] References Cited

U.S. PATENT DOCUMENTS

| | | | |
|---|---|---|---|
| 1,933,763 | 11/1933 | Russell | 40/324 |
| 2,133,636 | 10/1938 | Schaeffer | 446/347 X |
| 2,505,380 | 4/1950 | Blefeld | 40/324 |
| 2,781,650 | 2/1957 | Lee | 40/324 |
| 2,955,382 | 10/1960 | Boles | 248/102 X |
| 3,253,084 | 5/1966 | Taylor | 248/103 X |
| 3,514,887 | 6/1970 | Jacob | 40/324 |
| 3,773,287 | 11/1973 | Hechinger | 248/102 |
| 4,315,654 | 2/1982 | Crook | 248/102 X |

*Primary Examiner*—Harland S. Skogquist
*Attorney, Agent, or Firm*—Linval B. Castle

[57] ABSTRACT

A thin, lightweight, nursing bottle holder with handles for the movement of the holder by a baby includes a picture display at the distal end for attracting the baby's attention. The picture in the display is preferably one which changes as the bottle holder is tilted so that the baby will learn hand/eye and hand/mouth coordination while motivating the baby to continue the activity.

4 Claims, 4 Drawing Figures

COMBINED COORDINATION TRAINER AND BABY BOTTLE HOLDER

BRIEF SUMMARY OF THE INVENTION

This invention relates generally to apparatus for the coordination training of very young babies and in particular to a nursing bottle holder with handles in combination with visual display for interactive hand-to-eye and hand-to-mouth coordination exercises.

Recent studies indicate that babies have the basic intellect for some types of learning, even to some extent during the pre-natal period. The later results of this very early training are children with greatly improved attention spans, better physical coordination, and ultimately better quality students.

Training in the very early post-natal periods is generally limited to only physical stretching exercises, nursing, and soft vocal comforting by the parents. Very early in life the baby associates a nursing bottle with food and hunger satisfaction, soon learns to hold a nursing bottle and will concentrate only on that bottle while thus nursing. There are presently no means for allowing the baby to obtain any additional learning feedback while nursing or during non-nutrative sucking of a pacifier.

Briefly described, the invention to be described is for a nursing bottle holder with handles and also supporting a moveable visual display. This not only acts to hold the baby's attention during nursing but, appearing to move as the nursing bottle is moved, also provides simple hand-to-eye, mouth-to-hand, and mouth-respiratory coordination that produces discrete sensory changes in the baby's awareness thereby motivating the baby to continue engaging in the activity as well as teaching the baby aspects of the content of the presented pictorial or kinesthetic stimuli. This acts to further promote the baby's learning about essential interrelationships between the presented materials.

BRIEF DESCRIPTION OF THE DRAWING

In the drawing which illustrates the preferred embodiment of the invention.

DETAILED DESCRIPTION OF THE PREFERRED EMBODIMENT

Figure 1:
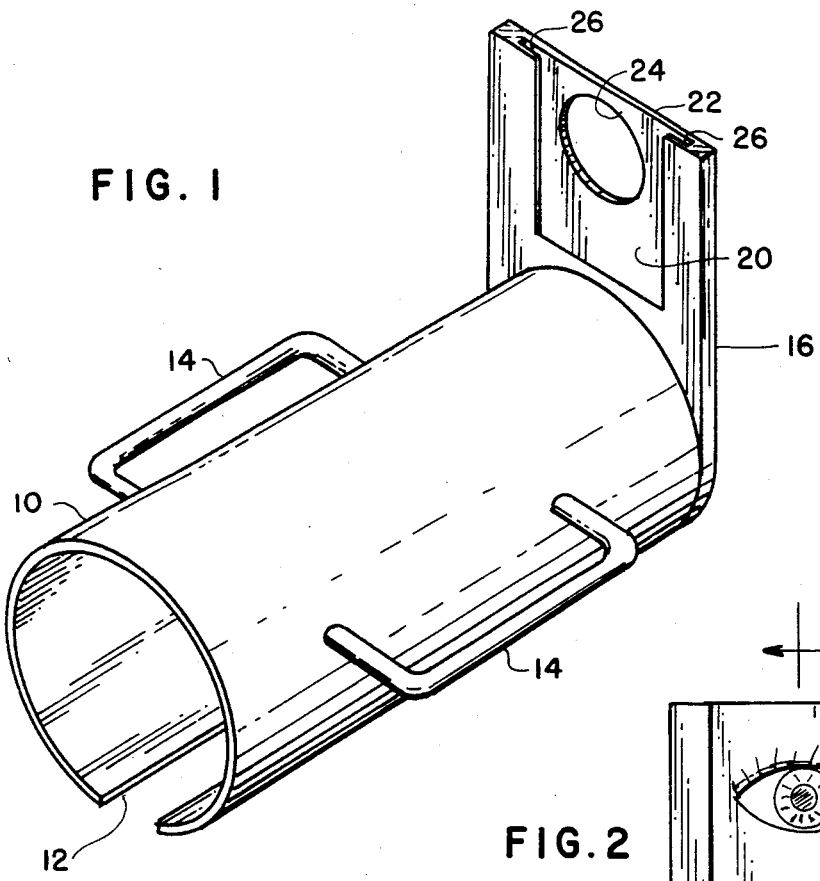
FIG. 1 is a perspective view illustrating the nursing bottle holder with visual display.
Figure 4:
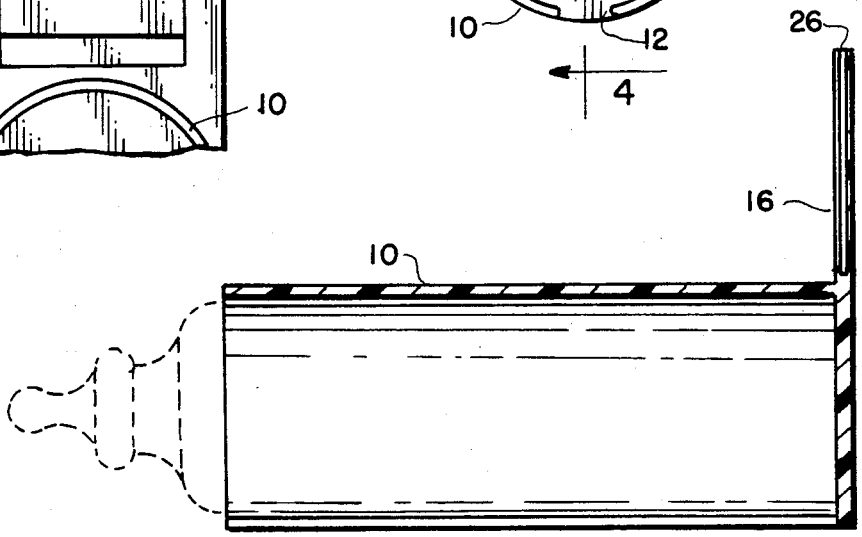
FIG. 4 is a sectional side elevational view of the bottle holder and display taken along the lines 4—4 of FIG. 2.

The nursing bottle holder with visual display illustrated in the perspective view of FIG. 1 includes a thin, light weight, resilient plastic tube 10 having a longitudinal slit 12 permitting the expansion of the tube to accomodate and grasp a typical nursing bottle such as shown by dashed lines in FIG. 4. The diameter of the resilient tube 10 should be slightly smaller than that of a nursing bottle to assure that the bottle will not slip out, and the length is somewhat shorter than the nursing bottle so that the nipple will extend from the open end of the tube.

The nursing bottle holder tube 10 is provided with handles 14 on each side of the tube so that a nursing baby can grasp the bottle holder and move it as will be subsequently explained. The handles are preferably plastic that are parallel with the longitudinal axis of the tube and spaced from the exterior surface thereof as illustrated.

Attached to one end of the bottle holder tube 10 is a display carrier 16 which may cover the entire open end of the tube, as illustrated, or may cover only the upper portion of the tube to thereby reduce overall weight of the bottle holder. The display carrier is planar and substantially normal to the longitudinal axis of the tube 10, and extends above the surface of the tube to support a visual display in the form of a photograph or sketch that is preferable mounted behind a Fresnel type of film so tht the images will appear to change as the angular axis from baby's eye to the image is altered as illustrated in FIGS. 2 and 3.

Figure 2:
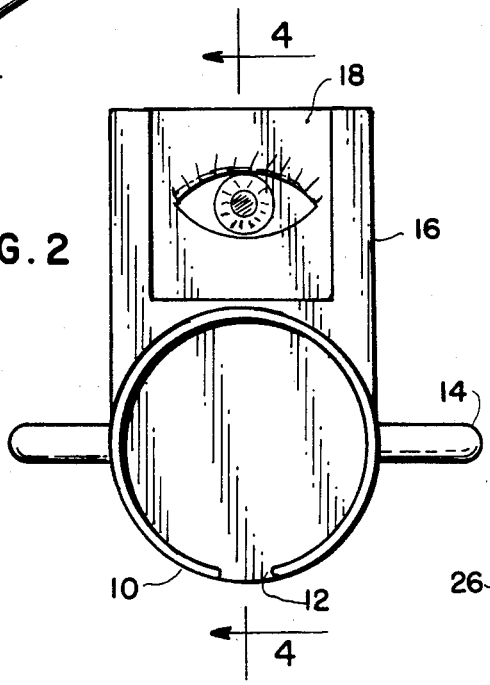
FIG. 2 is an end elevational view of the bottle holder as viewed from the baby's eye and illustrates a visual display of an open eye.
Figure 3:
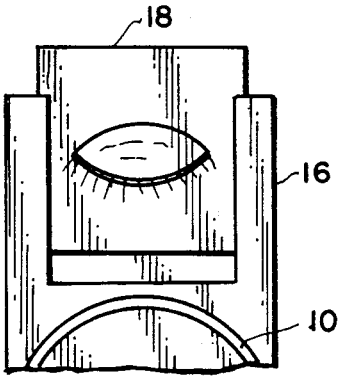
FIG. 3 is a partial end elevational view of the bottle holder illustrating a closed eye in the displaced Fresnel type display.

FIG. 2 illustrates the bottle holder tube 10, the diametrically positioned handles 14, and the display carrier 16 carrying a sketch or photograph slide 18 of an open eye. As mentioned above, the image in the slide 18 is preferably mounted behind a clear plastic Fresnel type sheet so that vertical movement of the displayed slide will alter the image so that the open eye of FIG. 2 appears closed to FIG. 3. There are many other types of sketches or photographs that may be used in the display carrier 16 that will effectively provide a visual stimulus and maintain the attention of the baby.

FIGS. 1 and 4 best illustrate the details of the display carrier 16 on the nursing bottle holder tube 10. The carrier is preferably attached to only the top arcuate half of the holder tube so that the slitted tube may be diametrically expanded to grasp a nursing bottle. The carrier contains a central rectangular open section 20 with a thin distal wall 22 having a relatively large "finger" hole 24 therein to enable insertion and removal of a display slide 18. The side and bottom edges of the open section 20 have grooves 26 to provide sliding engagement for the display slides 18.

FIG. 4 is a sectional side elevational view of the nursing bottle holder 10 and display carrier 16, and further illustrates in dashed lines a typical nursing bottle clamped in the resilient holder. As the baby holds the holder 10 while nursing, one image will appear in the display slide 18, such as shown in FIG. 2. Any slight vertical movement of the bottle holder 10 will then change the slide image, such as shown in FIG. 3. Attention is thus drawn and concentrated on the image and, very soon after the first use, the baby will anxiously grab for the bottle holder to move it to view the moving display picture. Thus, the baby very soon learns to coordinate the necessary hand movements to alter the observed image while nursing.

The preferred embodiment described a nursing bottle holder only. The display carrier of the disclosed bottle holder may, if desired, be made a part of a non-nutrative nursing device such as a pacifier to obtain substantially the same learning feedback. Thus, the invention is intended to be broadly construed and limited only by the scope of the appended claims.

We claim:

1. A baby trainer enabling an infant to obtain learning feedback while nursing, said trainer including:

a tubular member having first and second ends, said member for securely holding a baby's nursing bottle with the nipple of said bottle extending from the second end of said member;

a pair of handles on said tubular member, said handles extending from each exterior side surface of said tubular member and being substantially parallel with the axis of said member for enabling a baby to hold and move said tubular member; and a visual display for supporting a picture slide at the first end of said tubular member, a picture slide in said visual display being observable by a baby nursing a bottle at the second end of said tubular member.

2. The baby trainer claimed in claim 1 wherein said tubular member is resilient and has a longitudinal slit in the surface for diametrically expanding the tubular member to grasp and retain said nursing bottle.

3. The baby trainer claimed in claim 1 wherein said visual display extends above the surface of said tubular member and includes a recessed area having slotted internal edges for inserting and removing a picture slide normal to the line of sight of a baby at the second end of said tubular member.

4. The baby trainer claimed in claim 3 wherein an image in said picture slide in said visual display appears to change as the angle between the baby's view and said resilient tube is altered to thereby present different images as the baby tilts said tube.

* * * * *